US008513579B2

(12) United States Patent
Byun

(10) Patent No.: US 8,513,579 B2
(45) Date of Patent: Aug. 20, 2013

(54) HEATER ASSEMBLY FOR MICROWAVE OVEN AND MICROWAVE OVEN HAVING THE SAME

(75) Inventor: Jun-Bo Byun, Changwon (KR)

(73) Assignee: LG Electronics Inc., Seoul (KR)

( * ) Notice: Subject to any disclaimer, the term of this patent is extended or adjusted under 35 U.S.C. 154(b) by 1026 days.

(21) Appl. No.: 11/813,787

(22) PCT Filed: Jun. 20, 2006

(86) PCT No.: PCT/KR2006/002371

§ 371 (c)(1),
(2), (4) Date: Jul. 12, 2007

(87) PCT Pub. No.: WO2006/137678

PCT Pub. Date: Dec. 28, 2006

(65) Prior Publication Data

US 2008/0296292 A1 Dec. 4, 2008

(30) Foreign Application Priority Data

Jun. 20, 2005 (KR) ..... 20-2005-0017748 U

(51) Int. Cl.
*H05B 6/64* (2006.01)
*F24C 15/32* (2006.01)

(52) U.S. Cl.
USPC ..... 219/757; 219/680; 126/21 A

(58) Field of Classification Search
USPC ..... 219/680, 681, 685, 711, 757, 400, 219/405, 406, 411, 413, 484, 486, 494, 678; 99/339, 324, 447; 126/21 A, 21 R, 299 R, 126/299 D
See application file for complete search history.

(56) References Cited

U.S. PATENT DOCUMENTS

| | | | | |
|---|---|---|---|---|
| 4,835,367 | A | 5/1989 | Hoffman | 219/377 |
| 2001/0004077 | A1 * | 6/2001 | Lee et al. | 219/757 |
| 2003/0024925 | A1 * | 2/2003 | Graves et al. | 219/681 |

FOREIGN PATENT DOCUMENTS

| | | | |
|---|---|---|---|
| JP | 02-174818 | | 7/1990 |
| JP | 05-052352 | A * | 3/1993 |
| KR | 2002057154 | A * | 7/2002 |
| KR | 20-0291034 | | 10/2002 |
| KR | 20-0396178 | | 9/2005 |

OTHER PUBLICATIONS

English Translation of JP 05-052352, I et al., Mar. 2, 1993.*
PCT International Search Report dated Aug. 28, 2006.

* cited by examiner

*Primary Examiner* — Quang Van
*Assistant Examiner* — Hung D Nguyen
(74) *Attorney, Agent, or Firm* — KED & Associates, LLP

(57) ABSTRACT

A heater assembly for a microwave oven is provided. The heater assembly includes a ceramic heater and a halogen heater that provides heat used to cook food in a cooking chamber provided in a cavity assembly; a heater supporter fixed to a side of the cavity assembly, with the ceramic and halogen heaters fixed to the heater supporter; and a reflection plate provided above the ceramic and halogen heaters to reflect heat of the ceramic and halogen heaters to the cooking chamber, wherein a portion of the reflection plate corresponding to the ceramic heater is open in its longitudinal direction. With this structure, contact between a heating wire of the ceramic heater and the reflection plate is prevented and the heat dissipation of the ceramic and halogen heaters is obtained by means of airflow that is generated by a cooling fan assembly to cool electric parts.

5 Claims, 6 Drawing Sheets

HEATER ASSEMBLY FOR MICROWAVE OVEN AND MICROWAVE OVEN HAVING THE SAME

TECHNICAL FIELD

The present invention relates to a microwave oven, and more particularly, to a heater assembly for a microwave oven, which is installed in the microwave oven to generate and transfer heat used for cooking food to a cooking chamber, and a microwave oven having the same.

BACKGROUND ART

FIG. 1 is an exploded perspective view showing a major portion of a microwave oven having a conventional heater assembly, and FIG. 2 is an exploded perspective view showing the heater assembly for the microwave oven shown in FIG. 1.

As shown in the figures, a cooking chamber 11 for cooking food is provided in a cavity assembly 10 of the microwave oven. An upper surface and a rear surface of the cavity assembly 10 are defined by an upper plate 13 and a rear plate 15, respectively.

A cooling fan assembly 17 is provided at a front end of a side of the upper plate 13. In addition, a variety of electric parts such as a magnetron 18 and a high voltage transformer 19 are installed at a rear end of the side of the upper plate 13 corresponding to the rear of the cooling fan assembly 17. The cooling fan assembly 17 generates airflow for cooling the magnetron 18 and the high voltage transformer 19.

In addition, a porous portion 13A is provided at the other side of the upper plate 13. The porous portion 13A is provided with a plurality of vents formed in the form of a generally rectangular shape. The porous portion 13A is a portion through which the heat from a ceramic heater 21 and a halogen heater 22, which will be described below, is transferred to the cooking chamber 11.

Meanwhile, a heater assembly 20 is installed at a portion of the upper plate 13 corresponding to the porous portion 13A. The heater assembly 20 generates heat used for heating food and transfers the heat to the cooking chamber 11. The heater assembly 20 is provided with the ceramic and halogen heaters 21 and 22.

The ceramic and halogen heaters 21 and 22 substantially generate heat used for heating food in the cooking chamber 11. The ceramic and halogen heaters 21 and 22 are formed to extend in their longitudinal directions, and heating wires (not shown) are installed therein to extend in the longitudinal directions, respectively.

In the meantime, both ends of each of the ceramic and halogen heaters 21 and 22 are provided with terminals connected to both ends of each heating wire. A lead wire W1 is connected to each of the terminals. In addition, the ends of the ceramic and halogen heaters 21 and 22 are provided with insulators 21A and 22A, respectively.

The ceramic and halogen heaters 21 and 22 are fixed to a heater supporter 23. Fixing brackets 23B are provided on both ends of an upper surface of the heater supporter 23 corresponding to the ends of the ceramic and halogen heaters 21 and 22. The fixing brackets 23H serve to fix the ceramic and halogen heaters 21 and 22. In addition, the heater supporter 23 is fixed to the upper plate 13, with the ceramic and halogen heaters 21 and 22 being fixed to the heater supporter 23.

Further, a reflection plate 24 is provided above the ceramic and halogen heaters 21 and 22. The reflection plate 24 serves to reflect the heat of the ceramic and halogen heaters 21 and 22 to the cooking chamber 11, i.e., downwardly. As specifically shown in FIG. 2, the reflection plate 24 is formed to have a cross-section of two successive trapezoids corresponding to the respective ceramic and halogen heaters 21 and 22. The reflection plate 24 is formed with a plurality of vent holes 24H. The vent holes 24H define passages for allowing air to flow for cooling the ceramic and halogen heaters 21 and 22.

Supports 24A and 24B are provided at both ends of the reflection plate 24 corresponding to the ceramic and halogen heaters 21 and 22, respectively. The supports 24A and 24B extend from both the ends of the reflection plate 24 to incline downward. In addition, the supports 24A and 24B support the ends of the ceramic and halogen heaters 21 and 22 fixed to the fixing brackets 23B of the heater supporter 23, respectively.

In addition, fixing flanges 25 are provided at both side ends of the reflection plate 24 perpendicular to the supports 24A and 24B. The fixing flanges 25, which are brought into close contact with the upper plate 13, are formed with a plurality of through-holes 25H for fixing the reflection plate 24.

A pair of heater covers 27 and 28 are provided above the reflection plate 24 in order. The heater covers 27 and 28 serve to prevent heat and microwave of the ceramic and halogen heaters 21 and 22 from being transferred out of the cooking chamber 11, i.e., in the microwave oven.

Reference numeral 13H, which has not yet been described, designates a fastening hole formed in the upper plate 13, and reference numerals 27H and 28H designate through-holes formed in the heater covers 27 and 28, respectively. The fastening holes 13H and through-holes 27H and 28H are portions which fastening screws S1 are fastened to or penetrate through, respectively, in order to fix the heater assembly 20 to the upper plate 13.

However, the conventional heater assembly for a microwave oven has the following problems.

Since the interior of the halogen heater 22 should be maintained in a vacuum state with halogen gas filled therein, the halogen heater 22 is installed to the heater supporter 23 with the insulators 22A previously fixed to the halogen heater 22. However, since the insulators 21A are fixed to the ceramic heater 21 during a process of manufacturing a microwave oven, the insulators 21A may incompletely insulate the ceramic heater 21 due to working errors and the like. Therefore, in the ceramic heater 21, the heating wire that expands by overheating is brought into contact with supports 24A of the reflection plate 24, thereby potentially causing sparks.

In order to prevent such a phenomenon, there may be provided a cooling fan for dissipating heat of the ceramic heater 21 in addition to the cooling fan 17 for cooling electric parts. Therefore, in such a case, there is a disadvantage in that the configuration of a microwave oven is complicated.

DISCLOSURE

Technical Problem

Accordingly, the present invention is conceived to solve the aforementioned problems in the prior art. An object of the present invention is to provide a heater assembly for a microwave oven, which is configured such that a ceramic heater can be stably used, and a microwave oven having the same.

Another object of the present invention is to provide a heater assembly for a microwave oven configured to simply dissipate heat of a ceramic heater and a microwave oven having the same.

Technical Solution

According to an aspect of the present invention for achieving the objects, there is provided a heater assembly for a microwave oven, comprising a ceramic heater and a halogen heater for providing heat used for cooking food in a cooking chamber provided in a cavity assembly; a heater supporter fixed to a side of the cavity assembly, with the ceramic and halogen heaters fixed to the heater supporter; and a reflection plate provided above the ceramic and halogen heaters to reflect heat of the ceramic and halogen heaters to the cooking chamber, wherein a portion of the reflection plate corresponding to the ceramic heater is open in its longitudinal direction.

Preferably, a plurality of vent holes through which air flows are formed only in a portion of the reflection plate corresponding to the halogen heater.

The heater assembly may further comprise a heater cover for covering the ceramic and halogen heaters to prevent heat of the ceramic and halogen heaters from being transferred to the outside of the cooking chamber, and a heater duct provided above the heater cover to define a channel between an outer surface of the heater cover and an inner surface of the heater duct, wherein a cooling fan assembly provided at a side of the cavity assembly generates airflow for cooling an electric part, and a portion of the airflow flows in the channel between the heater cover and the heater duct, thereby indirectly dissipating heat of the ceramic and halogen heaters.

Preferably, a portion of the airflow generated by the cooling fan assembly is reflected from a side of the cavity assembly and is directed into the channel defined between the heater cover and the heater duct.

According to another aspect of the present invention, there is provided a microwave oven, comprising a cavity assembly with a cooking chamber provided therein; a cooling fan assembly provided at a side of the cavity assembly and generating airflow for cooling an electric part; and a heater assembly including a ceramic heater and a halogen heater provided at a side of the cavity assembly and providing heat to be transferred into the cavity assembly, a heater supporter fixed to a side of the cavity assembly with the ceramic and halogen heaters fixed to the heater supporter, a reflection plate provided above the ceramic and halogen heaters to reflect heat of the ceramic and halogen heaters to the cooking chamber, a heater cover for covering the ceramic and halogen heaters to prevent heat of the ceramic and halogen heaters from being transferred to the outside of the cooking chamber, and a heater duct provided above the heater cover and defining a channel between an outer surface of the heater cover and an inner surface of the heater duct, wherein a portion of the reflection plate corresponding to the ceramic heater is open in its longitudinal direction, the cooling fan assembly provided at the side of the cavity assembly generates airflow for cooling an electric part, and a portion of the airflow flows in the channel between the heater cover and the heater duct, thereby indirectly dissipating heat of the ceramic and halogen heaters.

Preferably, in a state where the airflow generated by the cooling fan assembly is directed toward a rear of the cavity assembly and cools the electric part, the airflow is reflected from an inside of a rear plate defining a rear surface of the cavity assembly and is directed toward a front of the cavity assembly, and the airflow flows in the channel between the heater cover and the heater duct, thereby indirectly dissipating heat of the ceramic and halogen heaters.

According to the present invention, there are advantages in that the contact between the heating wire of the ceramic heater and the reflection plate is prevented and the heat dissipation of the ceramic and halogen heaters is obtained by means of airflow that is generated by the cooling fan assembly for cooling electric parts.

ADVANTAGEOUS EFFECTS

As described in detail above, with the heater assembly for a microwave oven according to the present invention and the microwave oven having the same, the following advantages can be expected.

First, supports of a reflection plate for supporting both ends of a ceramic heater are removed in the present invention. Thus, a heating wire is not brought into contact with the supports of the reflection plate although the heating wire expands by overheating of the ceramic heater, whereby the ceramic heater is prevented from being damaged and the reliability of the product is improved.

In addition, according to the present invention, a cooling fan for cooling electric parts generates airflow, and a portion of the airflow flows in a channel defined between a heater cover and an air duct, thereby dissipating the heat of the ceramic heater. Therefore, an additional part for dissipating the heat of the ceramic heater is not required, resulting in reduction in production costs of the product.

BEST MODE

Hereinafter, a heater assembly for a microwave oven according to the present invention and a microwave oven having the same will be described in detail with reference to the accompanying drawings.

Figure 1:
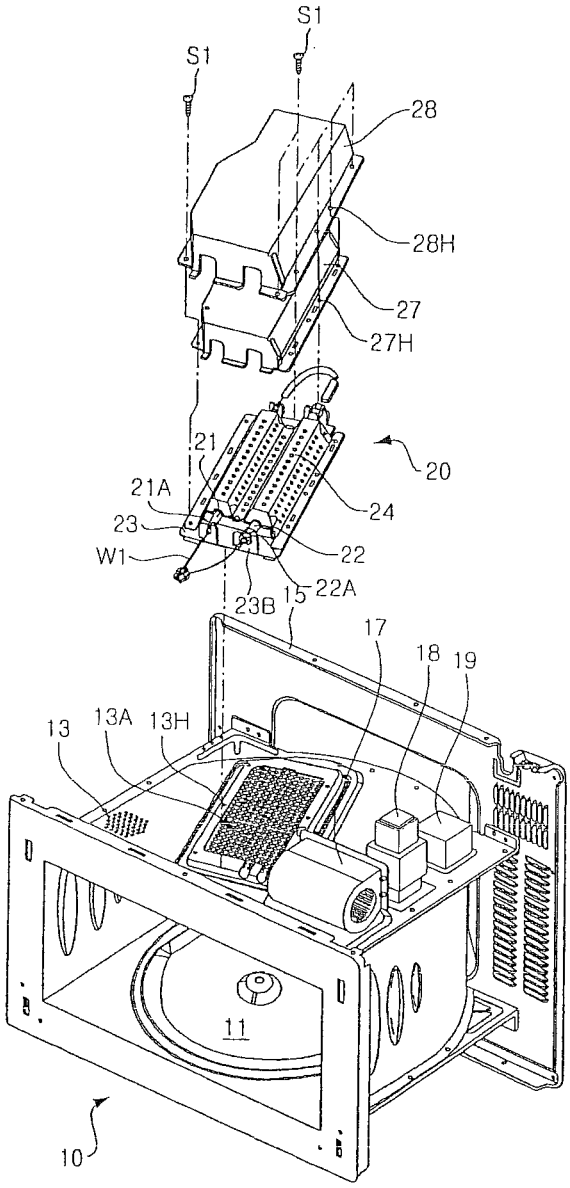
FIG.1 CONVENTIONAL ART
FIG. 1 is an exploded perspective view showing a major portion of a microwave oven having a conventional heater assembly.
Figure 2:
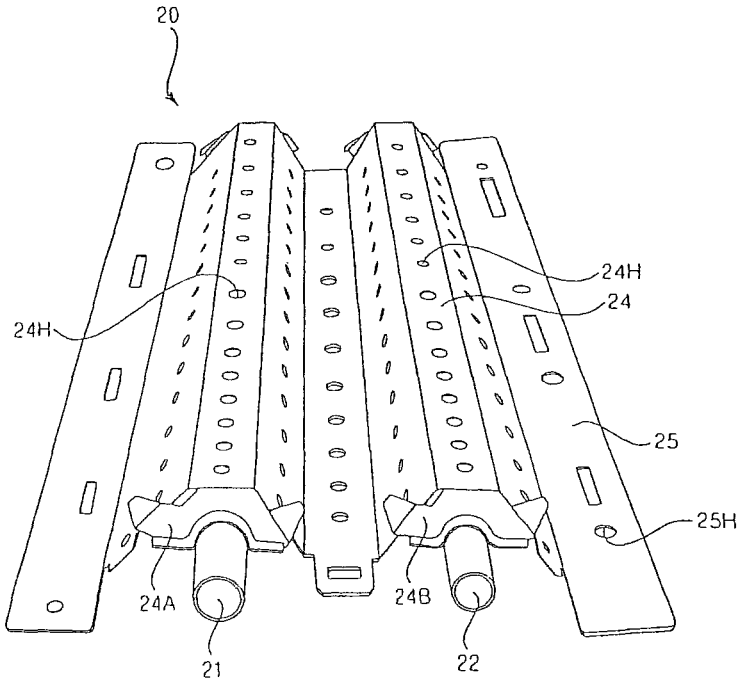
FIG.2 CONVENTIONAL ART
FIG. 2 is an exploded perspective view showing the heater assembly for the microwave oven shown in FIG. 1.
Figure 3:
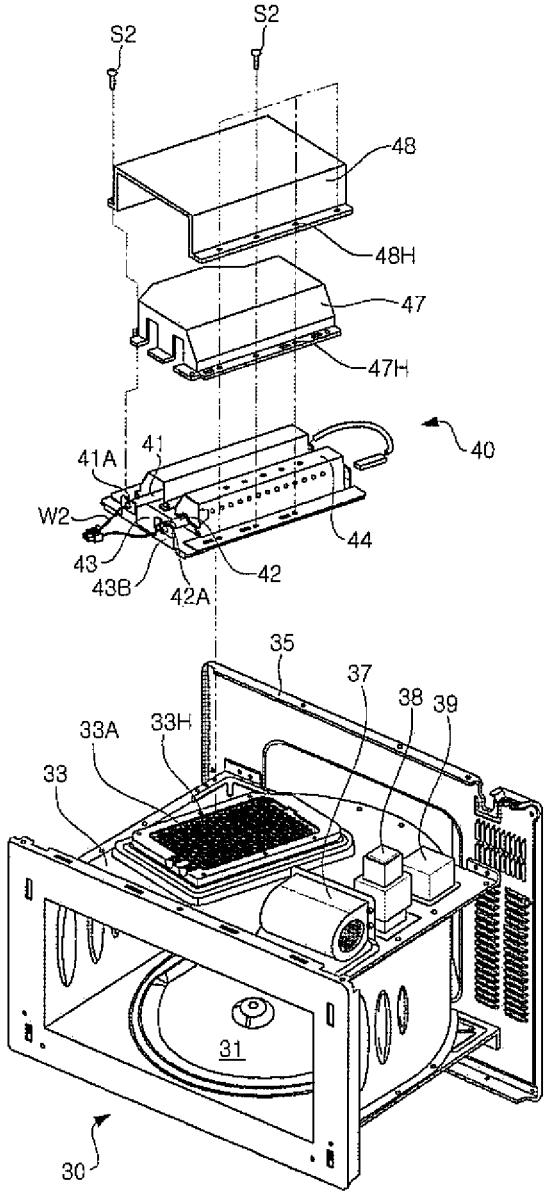
FIG. 3 is an exploded perspective view showing a microwave oven having a preferred embodiment of a heater assembly according to the present invention.
Figure 4:
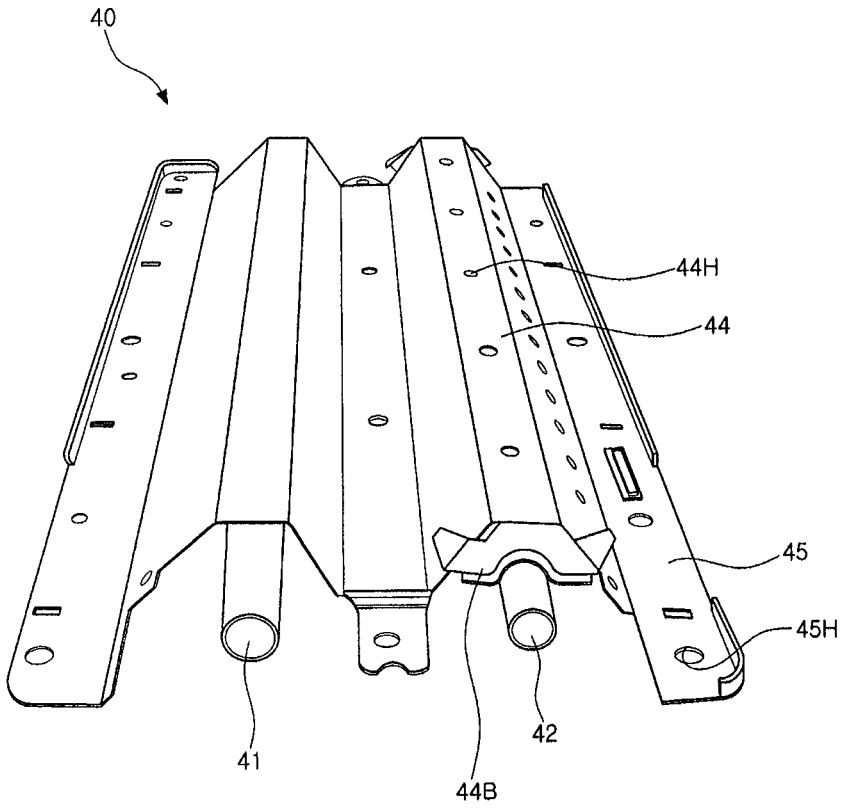
FIG. 4 is an exploded perspective view showing the embodiment shown in FIG. 3.
Figure 5:
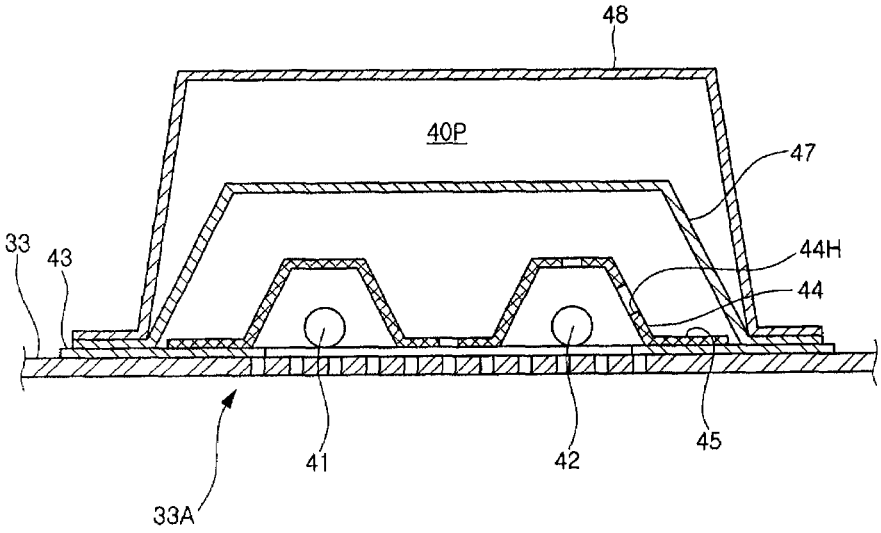
FIG. 5 is a side sectional view showing the embodiment shown in FIG. 3.

FIG. 3 is an exploded perspective view showing a microwave oven having a preferred embodiment of a heater assembly according to the present invention; FIG. 4 is an exploded perspective view showing the embodiment shown in FIG. 3; and FIG. 5 is a side sectional view showing the embodiment shown in FIG. 3.

As shown in the figures, a cooking chamber 31 which is selectively opened and closed by a door (not shown) is provided in a cavity assembly 30 of a microwave oven. An upper surface and a rear surface of the cavity assembly 30 are defined by an upper plate 33 and a rear plate 35, respectively.

In the meantime, a cooling fan assembly 37 is installed at a front end of a side of the upper plate 33. In addition, electric parts such as a magnetron 38 and a high voltage transformer 39 are installed at a rear end of the side of the upper plate 33 corresponding to the rear of the cooling fan assembly 37. The cooling fan assembly 37, which is installed to extend side to side, sucks air from both side ends thereof, and generates airflow which is directed toward the rear of the cavity assembly 30 and cools the electric parts.

A porous portion 33A is provided at the other side of the upper plate 33 corresponding to the opposite side of the cooling fan assembly 37 and the electric parts. The porous portion 33A is formed with a plurality of vents formed through the other side of the upper plate 33. In addition, a plurality of fastening holes 33H are formed in a portion of the upper plate 33 adjacent to the porous portion 33A.

In the meantime, the upper plate 33 is equipped with a heater assembly 40 for covering the porous portion 33A. The heater assembly 40 serves to generate heat used for heating food and to transfer the heat to the cooking chamber 31.

The heater assembly 40 is provided with a ceramic heater 41 and a halogen heater 42. The ceramic and halogen heaters 41 and 42, each of which extends in its longitudinal direction, include heating wires therein in the longitudinal directions, respectively. In addition, both ends of each of the ceramic and halogen heaters 41 and 42 are provided with terminals connected to both ends of each heating wire. A lead wire W2 is connected to each of the terminals of the ceramic and halogen heaters 41 and 42. The ends of the ceramic and halogen heaters 41 and 42 are also provided with insulators 41A and 42A, respectively.

The ceramic and halogen heaters 41 and 42 are fixed to a heater supporter 43. The heater supporter 43 is fixed to the upper plate 33, with the ceramic and halogen heaters 41 and 42 fixed to the heater supporter 43. In order to support the ends of the ceramic and halogen heaters 41 and 42, respectively, fixing brackets 43B are provided at both ends of an upper surface of the heater supporter 43 corresponding to the longitudinal ends of the ceramic and halogen heaters 41 and 42. Through-holes (not shown) are formed at both side ends of the heater supporter 43 to be perpendicular to the fixing brackets 43B.

In addition, a reflection plate 44 is provided above the ceramic and halogen heaters 41 and 42. The reflection plate 44 is formed to have a cross-section of two successive trapezoids. The reflection plate 44 reflects heat of the ceramic and halogen heaters 41 and 42 and transfers the heat to the interior of the cooking chamber 31.

The reflection plate 44 is formed with a plurality of vent holes 44H. The vent holes 44H allow a portion of the airflow to be introduced therethrough and to dissipate heat of the halogen heater 42, wherein the airflow is generated by the cooling fan assembly 37 and flows in a channel 40P that will be described below. At this time, the vent holes 44H are formed only in a portion of the reflection plate 44 corresponding to the halogen heater 42. This is because the removal of a fixing portion that will be described below improves the heat dissipation performance of the ceramic heater 41 and thus the heating performance of the ceramic heater 41 is deteriorated if additional vent holes are formed in a portion of the reflection plate 44 corresponding to the ceramic heater 41.

In addition, supports 44B are formed at both ends of the reflection plate 44 corresponding to both ends of the halogen heater 42. The supports 44B serve to support both the ends of the halogen heater 42. In the present invention above, the supports 44B are provided only at both the ends of the reflection plate 44 corresponding to both the ends of the halogen heater 42, so that the portion of the reflection plate 44 corresponding to the ceramic heater 41 is open in the longitudinal direction of the ceramic heater 41.

Meanwhile, fixing flanges 45 are provided at both side ends of the reflection plate 44 perpendicular to both the ends of the reflection plate 44 at which the supports 44B are provided. The fixing flanges 45 are brought into close contact with the upper plate 33. Moreover, each of the fixing flanges 45 is provided with a plurality of through-holes 45H.

A heater cover 47, which is formed in a flat hexahedral shape with a bottom face substantially open, is provided above the reflection plate 44. The heater cover 47 is fixed to the upper plate 33, and thus substantially covers the ceramic and halogen heaters 41 and 42. That is, the heater cover 47 serves to prevent heat, which is generated from the ceramic and halogen heaters 41 and 42 and transferred to the cooking chamber 31, and microwave, which is emitted into the cooking chamber 31 by the magnetron 38, from leaking into the cavity assembly 30 corresponding to the outside of the cooking chamber 31. Each of both side ends of the heater cover 47 is formed with a plurality of through-holes 47H.

In addition, a heater duct 48 is provided above the heater cover 47. The heater duct 48 is formed in a flat hexahedral shape that is open at a bottom face and both ends corresponding to the ends of the ceramic and halogen heaters 41 and 42. Further, the channel 40P is defined between an outer surface of the heater cover 47 and an inner surface of the heater duct 48. The channel 40P is a space in which a portion of the airflow generated by the cooling fan assembly 37 flows. The airflow flowing in the channel 40P causes the heat of the ceramic and halogen heaters 41 and 42 to be indirectly dissipated.

Hereinafter, the operation of the heater assembly for a microwave oven according to the present invention thus configured and the microwave oven having the same will be described.

First, a process of installing the preferred embodiment of the heater assembly for a microwave oven according to the present invention will be described.

The ceramic and halogen heaters 41 and 42 are fixed to the heater supporter 43. At this time, the ends of the ceramic and halogen heaters 41 and 42 are fixed through the fixing brackets 43B of the heater supporter 43. In addition, the heater supporter 43 is installed on the porous portion 33A of the upper plate 33 of the cavity assembly 30. At this time, the through-holes of the heater supporter 43 are positioned corresponding to the fastening holes 33H of the upper plate 33.

Next, the reflection plate 44 is installed above the ceramic and halogen heaters 41 and 42. At this time, the through-holes 45H of the reflection plate 44 are positioned corresponding to the fastening holes 33H of the upper plate 33 and the through-holes of the heater supporter 43. Further, both the ends of the halogen heater 42 are supported by the supports 44B of the reflection plate 44.

In addition, fastening screws S2, which penetrate the through-holes 45H of the reflection plate 44 and the through-holes of the heater supporter 43, are fastened to the fastening holes 33H of the upper plate 33. Thus, the heater supporter 43, to which the ceramic and halogen heaters 41 and 42 are fixed, and the reflection plate 44 are fixed to the upper plate 33.

In such a state, the heater cover 47 and the heater duct 48 are installed above the reflection plate 44 in order. At this time, fastening screws S2, which penetrate the through-holes 47H of the heater cover 47 or through-holes 48H of the heater duct 48, are fastened to the fastening holes 33H of the upper plate 33, so that the heater cover 47 and the heater duct 48 are fixed to the upper plate 33.

Next, a process of cooking food with the preferred embodiment of the heater assembly for a microwave oven according to the present invention will be described in detail.

First, in a state where the cooking chamber 31 is opened by opening the door of the microwave oven, food to be cooked is accommodated in the cooking chamber 31. Then, by manipulating an operating portion of the microwave oven, the heater assembly 40, i.e., substantially the ceramic and halogen heaters 41 and 42 begin to generate heat.

Then, the heat generated from the ceramic and halogen heaters 41 and 42 is transferred to the interior of the cooking chamber 31 through the porous portion 33A. Thus, the food accommodated in the cooking chamber 31 is cooked by the heat of the ceramic and halogen heaters 41 and 42.

In the meantime, the portion of the reflection plate 44 corresponding to the ceramic heater 41 is open in its longitudinal direction. Thus, although the ceramic heater 41 is overheated and the heating wire expands, the phenomenon that the heating wire is brought into contact with the reflection plate 44 will be minimized. Further, since the portion of the reflection plate 44 corresponding to the ceramic heater 41 is open in the longitudinal direction, the heat dissipation performance of the ceramic heater 41, particularly, at both the ends of the ceramic heater 41 adjacent to the insulators 41A, is improved.

Finally, a process of dissipating heat of the preferred embodiment of the heater assembly for a microwave oven according to the present invention by means of the airflow from the cooling fan assembly will be described in detail with reference to the accompanying drawings.

Figure 6:
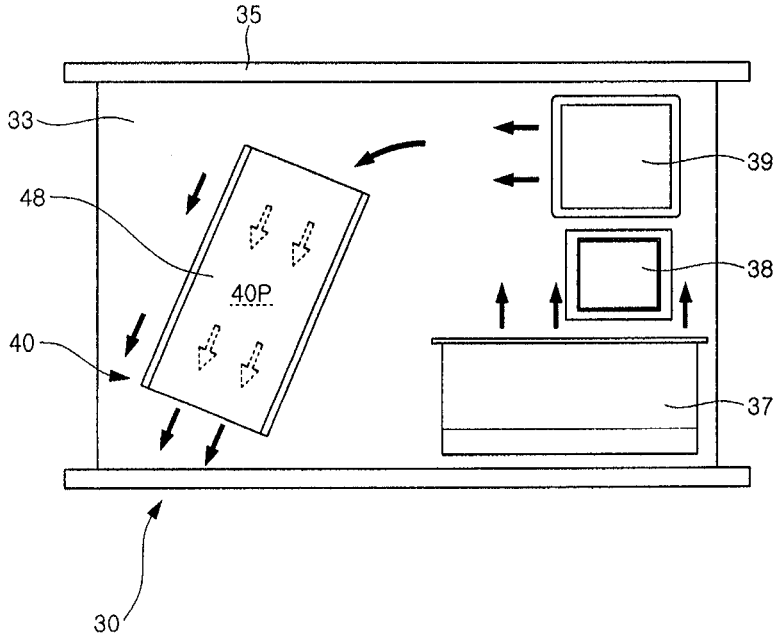
FIG. 6 is a view showing airflow that flows in the microwave oven having the embodiment shown in FIG. 3.

FIG. 6 is a view showing the airflow that flows in the microwave oven having the embodiment shown in FIG. 3.

As shown in the figure, when the cooling fan assembly 37 is driven, air is sucked from both the sides thereof and then airflow is generated to be directed to the rear of the cavity assembly 30. Such airflow cools a variety of the electric parts 38 and 39 installed at the rear of the cooling fan assembly 37. In addition, the airflow that has cooled the electric parts 38 and 39 is reflected from the inside of the rear plate 35 and is directed to the front of the cavity assembly 30.

The portion of the airflow that is directed to the front of the cavity assembly 30 as above flows into the channel 40P of the heater assembly 40, and thus, indirectly dissipates the heat of the ceramic and halogen heaters 41 and 42. Therefore, there is no deterioration of the heating performance caused from excessive heat dissipation of the ceramic and halogen heaters 41 and 42 or no problem due to overheating.

The scope of the present invention is not limited to the embodiment described above but is defined by the appended claims. It will be apparent that those skilled in the art can make various modifications and changes thereto within the scope of the invention defined by the claims.

The invention claimed is:

1. A microwave oven, comprising:

a cavity assembly with a cooking chamber provided therein;

a cooling fan provided at a side of the cavity assembly configured to generate airflow from the cooling fan towards at least one electric part to cool the at least one electric part; and a heater assembly, including:

a ceramic heater and a halogen heater provided at the side of the cavity assembly that provide heat to be transferred into the cavity assembly;

a heater supporter fixed to the side of the cavity assembly, with the ceramic and halogen heaters fixed to the heater supporter;

a reflection plate provided above the ceramic and halogen heaters to reflect heat of the ceramic and halogen heaters to the cooking chamber;

a heater cover that covers the ceramic and halogen heaters to prevent heat of the ceramic and halogen heaters from being transferred outside of the cooking chamber; and a heater duct provided above the heater cover that defines a channel between an outer surface of the heater cover and an inner surface of the heater duct, wherein a portion of the reflection plate corresponding to the ceramic heater is open in its longitudinal direction, and wherein the cooling fan provided at the side of the cavity assembly generates the airflow from the cooling fan towards the at least one electric part for cooling the at least one electric part, and a portion of the airflow flows in the channel between the heater cover and the heater duct, and wherein the airflow generated by the cooling fan is directed toward a rear of the cavity assembly and cools the at least one electric part, the airflow is reflected from an inside of a rear plate that defines a rear surface of the cavity assembly after cooling the at least one electric part and is directed toward a front of the cavity assembly, and the airflow flows in the channel between the heater cover and the heater duct, wherein the channel is positioned in a path of the airflow after the at least one electric part to dissipate heat of the ceramic and halogen heaters.

2. The microwave oven as claimed in claim 1, wherein the at least one electric part comprises a magnetron and a high voltage transformer disposed adjacent to the cooling fan.

3. The microwave oven as claimed in claim 2, wherein a central longitudinal axis of the heater assembly is positioned at an angle with respect to the rear plate so that the airflow flows into the channel.

4. The microwave oven as claimed in claim 1, wherein a plurality of vent holes through which air flows is formed only in a portion of the reflection plate corresponding to the halogen heater.

5. The microwave oven of claim 1, wherein a portion of the reflection plate corresponding to the halogen heater is open in its longitudinal direction, and wherein a support is provided on the reflection plate to cover the open portion corresponding to the halogen heater.

* * * * *